US008197364B2

(12) United States Patent
Henkel

(10) Patent No.: US 8,197,364 B2
(45) Date of Patent: Jun. 12, 2012

(54) TRAINING DEVICE FOR BEACH VOLLEYBALL PLAYERS

(76) Inventor: Francis J Henkel, Long Beach, NY (US)

( * ) Notice: Subject to any disclaimer, the term of this patent is extended or adjusted under 35 U.S.C. 154(b) by 82 days.

(21) Appl. No.: 12/769,250

(22) Filed: Apr. 28, 2010

(65) Prior Publication Data

US 2011/0269579 A1 Nov. 3, 2011

(51) Int. Cl.
*A63B 69/00* (2006.01)

(52) U.S. Cl. ..... 473/459; 473/430

(58) Field of Classification Search ..... 473/423, 473/424, 427, 429, 430, 459
See application file for complete search history.

(56) References Cited

U.S. PATENT DOCUMENTS

| | | | | |
|---|---|---|---|---|
| 3,397,885 | A | 8/1968 | Nash, Jr. | |
| 3,897,950 | A | 8/1975 | Keller | |
| 4,147,353 | A * | 4/1979 | Moore | 473/575 |
| 4,462,599 | A * | 7/1984 | Brown | 473/430 |
| 4,592,549 | A * | 6/1986 | Ryan | 473/430 |
| 4,647,042 | A | 3/1987 | Bruce | |
| 4,881,742 | A | 11/1989 | Hargreave | |
| 5,060,946 | A | 10/1991 | Taylor | |
| 5,238,251 | A | 8/1993 | Staka | |
| 5,307,598 | A * | 5/1994 | West | 52/155 |
| 5,460,364 | A * | 10/1995 | Ring | 473/429 |
| 5,484,145 | A * | 1/1996 | Shriver | 473/454 |
| 5,575,481 | A | 11/1996 | Lovetere et al. | |
| 5,611,539 | A * | 3/1997 | Watterson et al. | 473/197 |
| 5,683,315 | A | 11/1997 | Ring | |
| 5,755,631 | A | 5/1998 | Paschka | |
| 5,792,014 | A * | 8/1998 | Brown | 473/430 |
| 5,823,895 | A | 10/1998 | Rasic | |
| 5,913,739 | A * | 6/1999 | Brenneisen | 473/430 |
| 6,099,419 | A | 8/2000 | Incaudo et al. | |
| 6,672,979 | B2 | 1/2004 | Brenneisen | |
| 7,041,016 | B1 | 5/2006 | Omtvedt | |
| 7,445,568 | B1 * | 11/2008 | Steffensmeier | 473/430 |
| 7,998,003 | B2 * | 8/2011 | Orr | 473/426 |
| 2005/0037874 | A1 * | 2/2005 | McCoy | 473/430 |
| 2010/0009784 | A1 * | 1/2010 | Wycoff | 473/429 |
| 2010/0130312 | A1 * | 5/2010 | Fuentes | 473/429 |

OTHER PUBLICATIONS http:www.spiketrainer.com—retrieved on May 17, 2010.

* cited by examiner

*Primary Examiner* — Mark Graham
(74) *Attorney, Agent, or Firm* — John S. Economou

(57) ABSTRACT

A volleyball training device includes a telescoping vertical member having a height adjustable between a predetermined minimum and maximum height. The telescoping vertical member has a lower end adapted to be mounted in the ground and an upper end. A horizontal member having a first end and a second end is attached to the upper end of the telescoping vertical member adjacent to the first end thereof. A flexible member having a first end and a second end is connected adjacent to the second end of the horizontal member at a first end thereof. A volleyball holder is coupled to the second end of the flexible member and is adapted to securely hold a volleyball in a manner which allows a user to strike a top portion thereof when the volleyball is positioned within the volleyball holder.

15 Claims, 4 Drawing Sheets

TRAINING DEVICE FOR BEACH VOLLEYBALL PLAYERS

FIELD OF INVENTION

This invention relates to a training device for beach volleyball players.

BACKGROUND OF THE INVENTION

Beach volleyball is a variant of the game of volleyball which is played on a sand-covered surface such as found at a beach. As with any sport, beach volleyball players wishing to improve their skills need to practice, either by actual game play or on their own. In particular, beach volleyball skills are different than indoor volleyball skills because of the added difficulty of contending with the varying footing caused by the sand-covered surface found at the beach. This sand-covered surface is a significant factor that must be taken into account by the beach volleyball player, as this surface decreases a player's physical abilities, e.g., it requires a greater effort from a player and affects the timing of that player. Although there have been devices produced to allow a volleyball player to practice skills necessary to play in a volleyball game played indoors in a gymnasium, such devices have certain deficiencies which do not provide optimum benefit when used at a beach or cannot be adapted for use on a beach. Furthermore, a training device for beach volleyball players must allow for the practice of all possible types of attacks, including in particular both the spike shot, which requires access to the top side of the ball, and the cut shot, which requires access to the sides of the ball, while training in the sand (i.e., at the beach and not indoors in a gymnasium). Such a training device should allow the practice of all types of ball strikes, including cuts, pokes, rolls, serves as well as simulated blocks, without the need for continuous reset of the device and without the assistance of another person, and while training in the sand. In addition, such training device should be portable, self-standing and easy to assemble and disassemble at the beach for practice, and easy to use. Furthermore, the optimum beach volleyball training device should be adjustable to accommodate players of different heights and skill levels and should use an ordinary beach volleyball.

U.S. Pat. No. 3,397,885 discloses in FIG. 1 a baseball batting practice device 10 which includes a ball 20 hanging via flexible member 14 from an inverted L-shaped structure formed from two cylindrical vertical members 22, 28 and horizontal member 32. Such device is not optimally adaptable for use as a beach volleyball training device because the attachment of flexible member 14 at the top of ball 20 does not allow for practice of spike strikes. U.S. Pat. Nos. 4,647,042, 5,575,481; 5,683,315, 5,823,895 and 6,099,419 each also discloses a sports practice device having a flexible member attached to the top side of a ball and thus suffer at least the same deficiency as the '885 patent.

U.S. Pat. No. 3,897,950 discloses in FIG. 1 a volleyball training device in which a ball 17 is held between a pair of arms 14, 15 having respective ball holders 16, 20 attached thereto. Tapered surfaces 30, 31 cradle the ball until a practicing player strikes the ball 17, after which point the ball 17 will have to be retrieved and reinstalled on the ball holders 16, 20 (or a new ball 17 will be installed) by either using a stepladder or by raising and lowering the entire structure. Arms 14, 15 are connected to a vertical member 13, which is coupled to another vertical member 12, which, in turn, is mounted into a recess 11 in a heavy base 10. The '950 patent states that a second player should also hold and thus provide support for vertical members 12, 13 while a first player is using the training device. The volleyball training device of the '950 patent is not portable, due to the requirement of a heavy base 10 for support and requires that the ball 17 be continually reset between ball holders 16, 20; requires a second person for support during use; and does not allow a player to practice certain types of cut strikes which require a strike to a side of the ball.

U.S. Pat. No. 4,881,742 discloses in FIGS. 1 to 3 a volleyball training device in which a volleyball 2 is placed within a nylon net bag 24 which hangs via a flexible support 6 below a horizontal arm member 4. Horizontal arm member 4 is coupled to a vertical member 8 via a mounting frame member 3. Vertical member 8 is comprised of two parts, members 10 and 12, and is coupled to a base 60 for support. As evident, the volleyball training device of the '742 patent is not portable owing to the need for base 60 and does not allow for practice of spike strikes because of the attachment of flexible member 6 at the top of ball 2.

U.S. Pat. No. 5,060,946 discloses in FIG. 1 a volleyball training device which has a ball 34 hanging via a tethering device 36 from an inverted L-shaped bracket formed from a horizontal member 10 and a vertical member comprising of telescoping tubes 14, 16. Tube 14 is coupled to a support base 12 via an upright support tube 18. The volleyball training device of the '946 patent is not portable due to the need for a heavy base 12 and does not allow for practice of spike strikes because of the attachment of tethering device 36 at the top of ball 34.

U.S. Pat. No. 5,238,251 discloses a volleyball training device having a ball 152 coupled to an arm 150 via a cup 158. The arm 150 is connected to a cam 130 that is mounted on an angle adjustment means (FIGS. 5 and 6) which, in turn, is mounted on a vertical member 24. Vertical member 24 is coupled to a vertical member 22 via a height adjusting mechanism (FIGS. 3 and 4). Vertical member 22 is connected to a base 12. The volleyball training device of the '251 patent is intended for indoor use, requires a complicated cam mechanism 130 and angle adjustment means, and, because of the need for a base 12 for support is not easily adaptable for use at the beach.

U.S. Pat. No. 5,755,631 discloses a handheld volleyball training device having a ball 12 fixedly connected to a first end of a wand 13 and a handle 17 connected to a second end of wand 13. Two players are required to use such device, a first player to strike ball 12 as a second user holds the handle 17 to position the ball 12 above a volleyball net 14. The volleyball training device of the '631 patent requires an additional player to hold the device and does not use an ordinary volleyball.

U.S. Pat. Nos. 5,913,739 and 6,672,979 each disclose a volleyball training device (FIG. 1) which requires a specially adapted volleyball 20 which is removably connected to a curved overhead arm assembly 30 that is coupled to an overhead arm 50 via a sheave assembly 40 and a nylon cord 59. The volleyball 20 is coupled to arm 30 via a specialized mounting mechanism which includes magnets mounted within volleyball 20. Curved overhead arm assembly 50 is connected to a vertical support 60 coupled to a separate vertical support 91 for net 92. The volleyball training device of the '739 and '979 patents requires is intended for attachment to an existing structure and does not use an ordinary volleyball.

U.S. Pat. No. 7,445,568 discloses a volleyball training device which requires a separate vertically extending structure, such as a basketball hoop, and is thus not portable and is not easily assembled and disassembled at the beach.

Each of the foregoing U.S. patents has particular deficiencies which, as described herein, are not present in the present invention. An object of the present invention is to provide a training device for beach volleyball players which allows practice for all types of ball strikes, without the need for continuous reset of the device and without the assistance of another person, but while practicing on a sand-covered surface. Another object of the invention is to provide a training device for beach volleyball players which is portable and easily assembled and disassembled at the beach. A further object of the present invention is to provide a training device for beach volleyball players which is adjustable to accommodate players of different heights and skill levels. A still further object of the present invention is to provide a training device for beach volleyball players which uses ordinary beach volleyballs. Still further objects and advantages will become apparent from a consideration of the ensuing description and drawings.

SUMMARY OF THE INVENTION

To achieve the foregoing objects, and in accordance with the purposes of the invention as embodied and broadly described herein, the volleyball training device of the present invention preferably includes a telescoping vertical member having a height which is adjustable between a predetermined minimum and maximum height. The telescoping vertical member has a lower end adapted to be mounted in the ground and an upper end. The volleyball training device also has a horizontal member having a first end and a second end. The horizontal member is attached to the upper end of the telescoping vertical member adjacent to the first end thereof. The volleyball training device also has a flexible member having a first end and a second end. The flexible member is connected adjacent to the second end of the horizontal member at a first end thereof. Finally, the volleyball training device includes a volleyball holder coupled to the second end of the flexible member. The volleyball holder is adapted to securely hold a volleyball in a manner which allows a user to strike a top portion thereof when the volleyball is positioned within the volleyball holder.

BRIEF DESCRIPTION OF THE DRAWINGS

The following detailed description, given by way of example and not intended to limit the present invention solely thereto, will best be understood in conjunction with the accompanying drawings in which.

DETAILED DESCRIPTION OF THE PREFERRED EMBODIMENT

Figure 1:
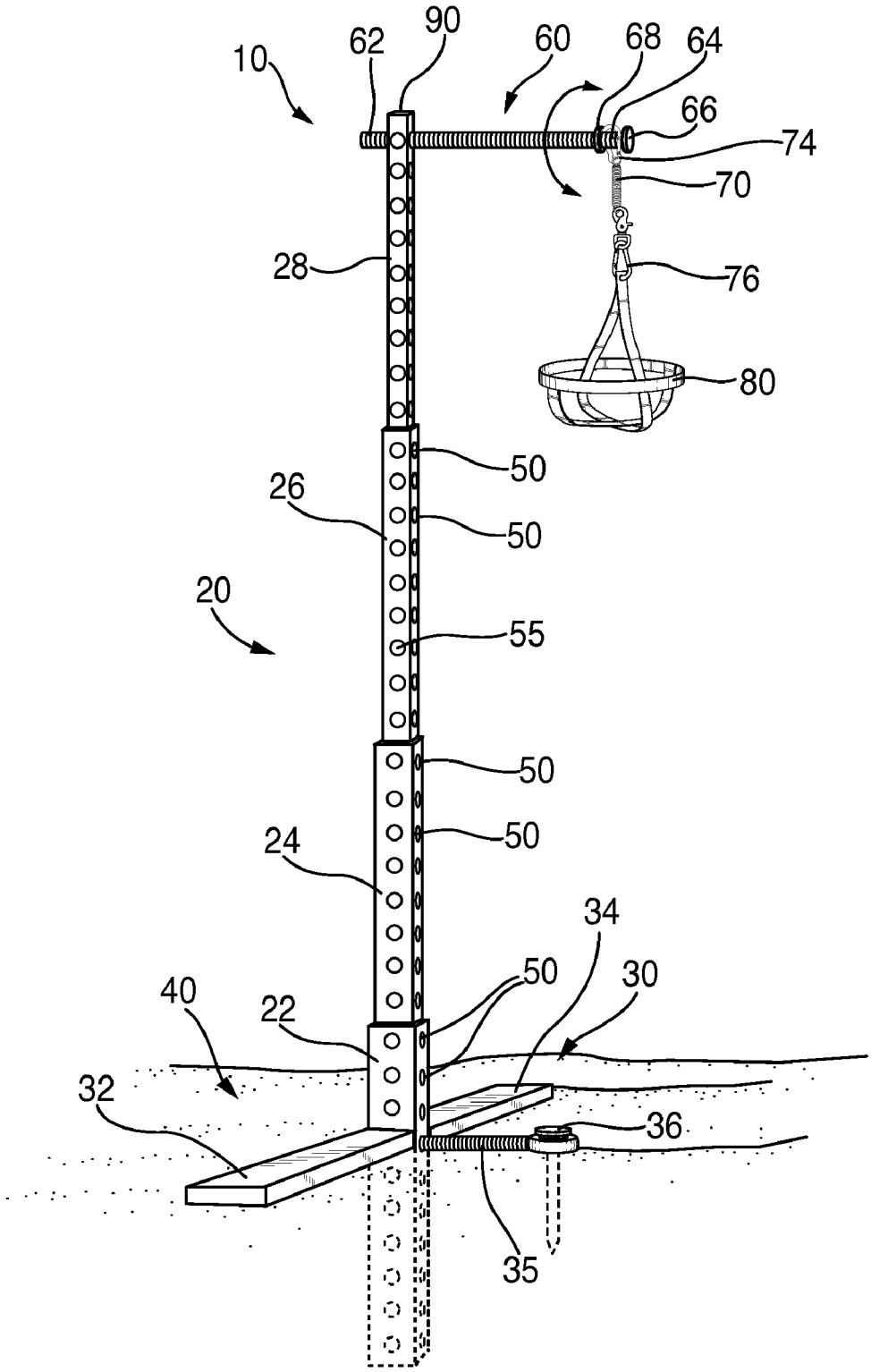
FIG. 1 is a side view of an embodiment of the beach volleyball training device of the present invention.

Referring now to the drawings and in particular FIG. 1, the volleyball training device 10 of the present invention comprises, in this embodiment, a vertical support 20 which consists, preferably of 4 four foot long sections of conventional square telescopic steel tubing sections 22, 24, 26, 28 (ranging from 2 inch square to 1¼" square), which are connected via conventional connectors 50 (e.g., bolts and wing nuts). Perforated holes 55 in the tubing allow the height of the vertical support to be adjusted from a lower height of 4 feet to an upper height of 12½ feet in ½ inch increments. A horizontal member 60 is fixedly connected at a upper end 90 of vertical support 20 adjacent to a first end 62 of horizontal member 60. Horizontal member 60 is approximately 2 feet long and preferably consists of a threaded rod conventionally attached, in a removable manner (e.g., bolt on one side and wing nut on the other side), at the upper end of section 28. As one of skill in the art will readily recognize, there are many alternative ways that vertical support 20 may be constructed to provide a telescoping structure in accordance with the embodiment of this invention. Likewise, there are also many different ways to construct horizontal member 60 to accomplish the requirements of the embodiment of this invention.

Vertical member 20 is preferably designed to be fixedly mounted in the ground, particularly but not limited to a sandy area such as typically found at a beach. Bottom tubing section 22 is preferably buried at least 2 to 3 feet into the ground, and has wing sections 32, 34 fixedly mounted thereto at ground level 40 to provide stability for vertical member 20. Each wing section 32, 34 is preferably formed from a wood member such as a length of 2×4 lumber (although, as one of ordinary skill in the art will readily recognize, wing sections 32, 34 may be constructed from any appropriate structure providing adequate support) and preferably extends outward 1 foot on each side. Wing sections 32, 34 are preferably connected to bottom tubing section 22 via a ⅜ inch threaded rod (not shown) which connects to both wings through bottom tubing section 22 for ease of set up and disassembly. One or more stakes 36 may also be provided which are preferably connected via an eye bolt 35 to bottom tubing section 22 for additional stability. Vertical member 20 may also be fixedly mounted in a conventional weighted base, such as base 10 shown in FIG. 1 of U.S. Pat. No. 3,897,950, hereby incorporated by reference herein, or fixedly fastened, e.g., via straps, to a pre-existing structure mounted in the ground (e.g., a fence post or a tennis court net post) or on the ground (e.g., a basketball pole mounted on a weighted base). In this manner, the volleyball practice device disclosed herein may be used both at the beach to get the full advantage of practicing on a sand-covered surface and at home or a local park to obtain the benefits of being able to practice all possible types of volleyball shots, albeit not on the preferred sand-covered surface.

Figure 2:
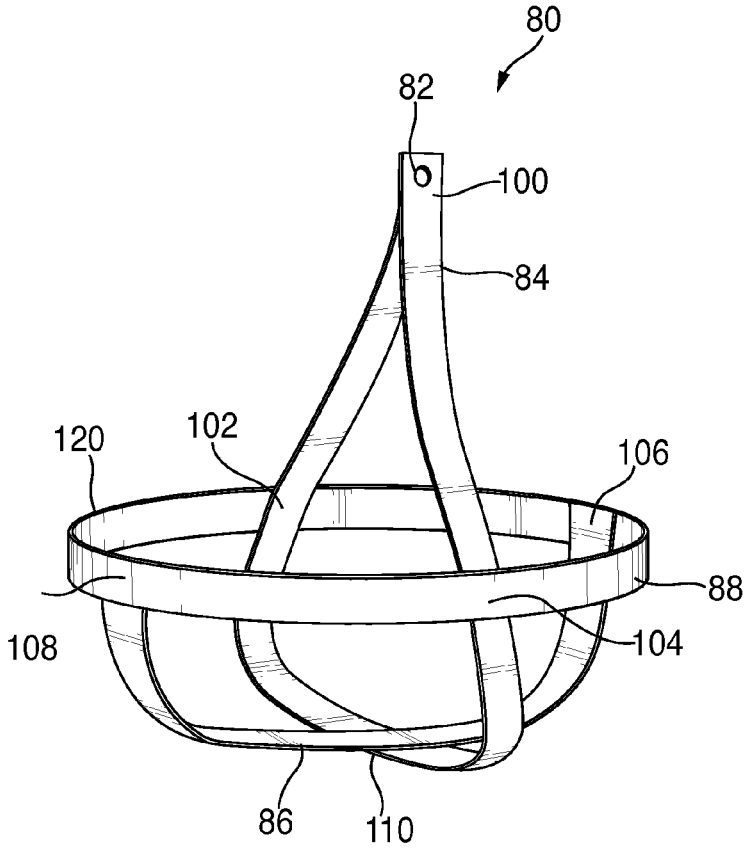
FIG. 2 is a detailed view of the ball holder shown in FIG. 1.

A volleyball holder 80, shown and described in greater detail in FIG. 2, is coupled adjacent to a second end 64 of horizontal member 60 via a flexible member 70. Flexible member 70 is preferably constructed, at least in part, from an extension spring 190 (as shown in more detail in FIG. 4) and is connected to horizontal member 60 at a first end 74 in a manner which allows it to rotate vertically around horizontal member 60, as shown by arrow 72. Bushings 66, 68 are attached adjacent to the second end 64 of horizontal member 60 to keep flexible member 70 from sliding off of flexible member 70 or from moving too close to vertical member 20. Flexible member 70 is connected to volleyball holder 80 at a second end 76.

As shown in FIG. 2, volleyball holder 80 forms a basket-like structure which holds a volleyball (not shown) in the air for practice. Volleyball holder 80 consists of three interconnected straps 84, 86, 88 which are each preferably formed from 1 inch nylon strapping. Strap 84 forms a vertical loop with the two ends thereof connected together (point 100), preferably by stitching, and preferably includes a metal grommet 82 passing through the two mated ends of strap 84 for connection to flexible member 70. Strap 88 forms a horizontal loop having an inner diameter just smaller than the outer diameter of a conventional beach volleyball, and is attached to strap 84 at points 102, 104. Strap 86 is just over one-half the length of the outer diameter of a conventional volleyball, and is attached, preferably by stitching, to strap 84 at point 110 and to strap 88 at points 106, 108. Volleyball holder 80 is preferably designed so that the upper edge 120 of strap 108 forms a horizontal plane that bisects the center of a volleyball placed therein. In this manner, a user has full access to the top side of the volleyball for practicing spike strokes, and also may practice all other volleyball shots, since the straps 84, 86, 88 securely hold the volleyball.

Figure 4:
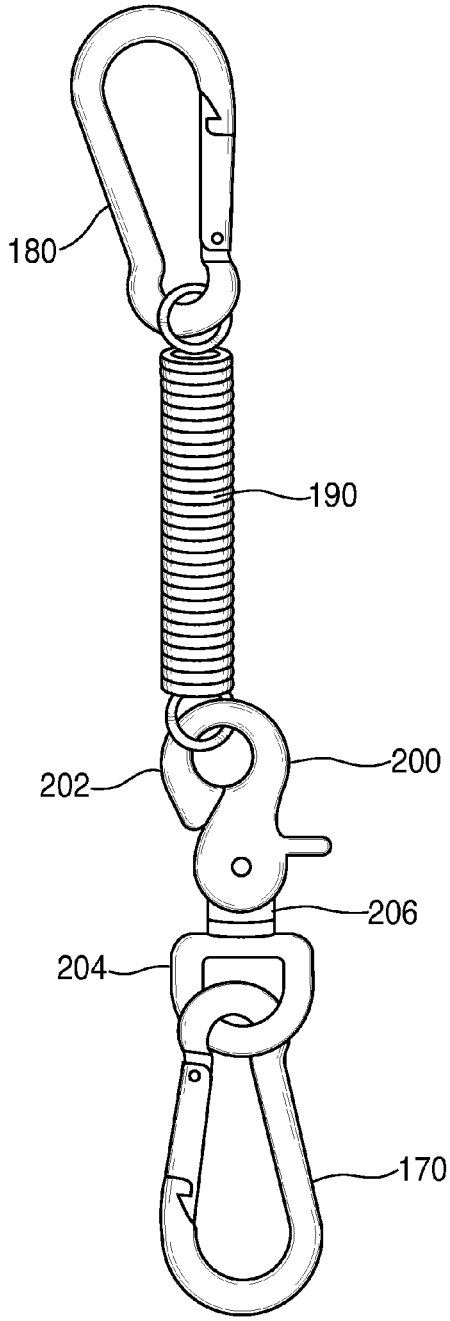
FIG. 4 is a detailed view of the flexible member used to support the ball holder shown in FIG. 1.

The construction of flexible member 70 is shown in FIG. 4 and preferably comprises a first snap hook 170, a second snap hook 180, an extension spring 190 and a lobster claw bolt snap hook 200, with first snap hook 170 adapted to be connected to horizontal member 60 (shown in FIG. 1) and second snap hook 180 adapted to be connected to volleyball holder 80 via metal grommet 82 (shown in FIG. 2), although adequate performance can be obtained using just an extension spring 190 or a combination of an extension spring 190 and a lobster claw bolt snap hook 200. Snap hook 180 allows the ball holder 80 to spin around horizontal member 60 during a hard strike in a vertical arc. As one of ordinary skill in the art will readily recognize, various types of fasteners may be substituted for snap hooks 170 and 180 to interconnect extension spring 190 with the volleyball holder 80 and the horizontal member 60, respectively. Lobster claw bolt snap hook 200 includes a lobster claw connector 202 and a loop 204 interconnected via a swivel connection 206. Swivel connection 206 on the lobster claw bolt snap hook 200 provides the benefit of allowing the volleyball in volleyball holder 80 to spin horizontally right or left when practicing cut shots. As one of ordinary skill in the art will readily recognize, any type of connector having a swivel connection can be substituted for lobster claw bolt snap hook 200 and still provide the volleyball in volleyball holder with the ability to spin horizontally. Also, as one of ordinary skill in the art will readily recognize, the swivel connection 206 can be interconnected between the spring 190 and the volleyball holder 80 or between the spring 190 and the horizontal member 60 and still achieve the function of providing horizontal spin of a volleyball mounted within volleyball holder 80.

Figure 5:
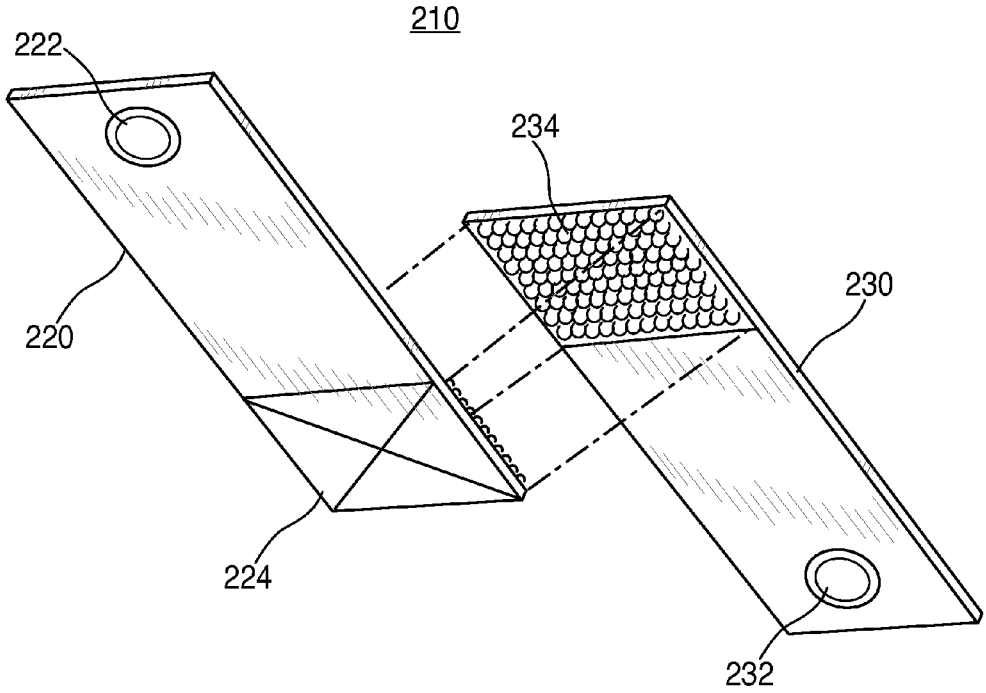
FIG. 5 is a detailed view of an additional feature of the flexible member.

FIG. 5 shows an alternative structure 210 for spring 190 and lobster claw bolt snap hook 200 which permits the volleyball holder 80 to become detached upon a ball strike and allow the user to gauge the effectiveness of the ball strike, e.g, by following the arc of the ball flight or determining where the ball first hits the ground. In particular, structure 210 includes a first strap 220, preferably formed from nylon strapping, which includes a grommet 222 mounted in a first end thereof and a first part 224 of a hook and loop fastener coupled to a second end, preferably by stitching. Structure 210 also includes a second strap 230, also preferably formed from nylon strapping, which includes a grommet 232 mounted in a first end thereof and a second part 234 of a hook and loop fastener coupled to a second end, preferably by stitching. This alternate structure 210 may be either substituted for spring 190 and lobster claw bolt snap hook 200, in which case, for example, grommet 222 is connected to snap hook 180, grommet 232 is connected to snap hook 170, and the two hook and loop fasteners 224, 234 are coupled together. In this manner, volleyball holder 80 will become detached upon a ball strike by a user, as the loop fasteners 224, 234 will separate. Alternatively, structure 210 can be connected between snap hook 170 and volleyball holder 80, by adding one more snap hook (not shown) for coupling structure 210 to the volleyball holder 80.

The present embodiment provides a beach volleyball training device which is easily transported, assembled and disassembled. In particular, the telescopic nature of vertical member 20 and the easily removable horizontal member 60 and wing sections 32, 34 allow all of the components to be carried in a bundle about four feet long, which bundle may be placed in reinforced fabric bag or simply tied together with a loop of rope which may also form a carrying handle. Furthermore, the addition of a heavy base or straps for interconnection to a fixed structure will allow the volleyball training device disclosed herein to be used in a variety of environments, e.g., at the beach, at home, at a park, etc.

Figure 3:
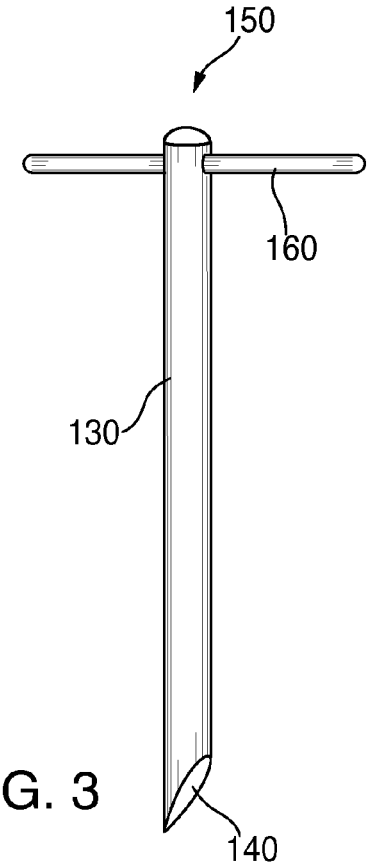
FIG. 3 is a detailed view of a sand hole remover used during setup of the volleyball training device of the present invention.

The beach volleyball training device shown in FIG. 1 is easily set up in any outside beach area where a 2 to 3 foot hole may be dug in the ground, and is particularly suited for use at the beach. The hole may be advantageously dug using the tool shown in FIG. 3, which consists of a 4 foot length of 2 inch diameter PVC pipe 130 having a first end 140 cut at a 45 degree angle and a second end 150 having a handle 160 attached thereto, e.g., through holes drilled in the PVC pipe 130.

Once the beach volleyball training device shown in FIG. 1 is set up, a user can adjust it to allow for practice of a wide variety of different volleyball skills in a manner that more closely simulates beach volleyball play than any other known conventional volleyball training device. The beach volleyball training device disclosed herein allows a user to simulate actual game play on the beach and in the sand, unlike many of the conventional training devices, and also allows the practice of both offensive and defensive skills. Furthermore, the volleyball training device disclosed herein allows a user to build skills and comfort level while actually practicing on a sand-covered surface, thereby building the player's so-called "sand legs." For example, the spike strike (or shot) can be practiced by setting up the device so that the volleyball holder positions the volleyball at a height just within the particular user's reach. This ensures that, for each repetition, the user will perform at a level requiring maximum lift out of the sand.

The user may practice the other types of attack shots in a similar manner, although the contact of the ball will be different for each different type of shot. These shots (or ball strikes) may include: (1) the cut shot where a user chops at the side of the volleyball giving it sidespin to the right or the left; (2) the poke shot where the user attacks the volleyball with the tips of the fingers or a closed fist hitting the ball on the underside or side portion of the volleyball to guide it in a particular direction; and (3) the roll shot where the user hits the face of the volleyball and pushes the volleyball forward creating topspin. The volleyball practice device disclosed herein allows a user to practice all of these shots with different levels of contact to simulate hitting the volleyball to all areas of the court, while practicing on a sand-covered surface. In addition, the volleyball training device disclosed herein allows a user to practice the jump serve by simulating the toss of the volleyball to a desired height (i.e., the height at which the volleyball holder is set). The user takes a similar approach as if attempting a spike shot but contacts the volleyball more toward the bottom and middle of the volleyball to create topspin with enough force to get the volleyball to clear the net but land within the court area. The volleyball practice device disclosed herein provides flexibility by allowing the user to first practice repeated shots without having to retrieve the ball, and then, by use of structure 210 shown in FIG. 5, allows the user to gauge the effectiveness of each ball strike as discussed above.

The volleyball practice device disclosed herein also allows a user to practice defensive skills such as a block. To practice defensive skills, the user sets up the volleyball holder at a desired height, and then can practice a standard straight up block (by jumping up with his or her arms pointed straight upward in front of the ball), a straight up swing block (where the user jumps straight up but swings his or her arms out to the right or left side), and blocks where the user approaches the ball (and net—either simulated or actual) with forward momentum to practice blocking the ball while avoiding contact with the net.

While the present invention has been particularly shown and described with reference to the preferred embodiments and various aspects thereof, it will be appreciated by those of ordinary skill in the art that various changes and modifications may be made without departing from the spirit and scope of the invention. It is intended that the appended claims be interpreted as including the embodiments described herein, the alternatives mentioned above, and all equivalents thereto.

What is claimed is:

1. A portable beach volleyball training device adapted to be temporarily mounted in the ground, comprising:

a telescoping vertical member adjustable between a predetermined minimum height and a predetermined maximum height, the telescoping vertical member having a lower end adapted to be fixedly mounted and an upper end;

a horizontal member having a first end and a second end, the first end of the horizontal member attached to the telescoping vertical member adjacent to the upper end thereof;

a flexible member having a first end and a second end, the first end of the flexible member connected to the horizontal member adjacent to the second end thereof;

a volleyball holder coupled to the second end of the flexible member, the volleyball holder adapted to securely hold a volleyball in a manner which allows a user to strike a top portion thereof when the volleyball is positioned within the volleyball holder; wherein the volleyball holder comprises:

a first strap forming a vertical loop, a first end of the first strap coupled to a second end of the first strap on the same side thereof; the first and second ends of the vertical loop coupled directly to the second end of the flexible member, a second strap forming a horizontal loop, the loop formed by the second strap having a diameter just larger than the diameter of a volleyball, the second strap coupled to two points on the first strap at two diametrically opposite points on the second strap; and wherein the vertical loop formed by the first strap contacts the volleyball along lower one-half of a vertical circumference of the volleyball but is spaced apart from an upper one-half of the vertical circumference of the volleyball such that a user can strike an upper portion of the volleyball during use without contacting the first strap; and means for temporarily securing the lower end of the telescoping vertical member anywhere in the ground.

2. The beach volleyball training device of claim 1, wherein the telescoping vertical member is formed from square telescopic steel tubing sections.

3. The beach volleyball training device of claim 1, wherein the horizontal member is formed from a threaded rod.

4. The beach volleyball training device of claim 1, further comprising wing members for securing the lower end of the telescoping vertical member in the ground.

5. The beach volleyball training device of claim 1, further comprising at least one eyebolt and associated stake for securing the lower end of the telescoping vertical member in the ground.

6. The beach volleyball training device of claim 1, further comprising a weighted base for securing the lower end of the telescoping vertical member to the ground.

7. The beach volleyball training device of claim 1, further comprising straps for securing the lower end of the telescoping vertical member to a fixed structure in the ground.

8. The beach volleyball training device of claim 1, wherein the flexible member comprises a spring.

9. The beach volleyball training device of claim 8, wherein the flexible member further comprises a connector for coupling the spring to the horizontal member.

10. The beach volleyball training device of claim 8, wherein the flexible member further comprises a connector for coupling the spring to the volleyball holder.

11. The beach volleyball training device of claim 8, wherein the flexible member further comprises a swivel connection coupled between the spring and the volleyball holder.

12. The beach volleyball training device of claim 8, wherein the flexible member further comprises a swivel connection coupled between the spring and the horizontal member.

13. The beach volleyball training device of claim 8, wherein the flexible member includes a connector which permits the volleyball holder to become detached upon a ball strike.

14. The beach volleyball training device of claim 1, further comprising:

a third strap forming a vertical semi-circle having first and second ends coupled to diametrically opposite points on the second strap, the third strap coupled to the first strap at a midpoint of the vertical semi-circle formed by the third strap.

15. The beach volleyball training device of claim 14, wherein the connections between the second strap and the third strap are offset by ninety degrees from the connections between the second strap and the first strap.

* * * * *